US005711767A

United States Patent [19]

Gande et al.

[11] Patent Number: 5,711,767

[45] Date of Patent: Jan. 27, 1998

[54] STABILIZERS FOR THE PREVENTION OF GUM FORMATION IN GASOLINE

[75] Inventors: Matthew E. Gande, Danbury, Conn.; Paul A. Odorisio, Leonia, N.J.; Ramraj Venkatadri, Ardsley; Geoffrey W. Broadhurst, Irvington, both of N.Y.

[73] Assignee: Ciba Specialty Chemicals Corporation, Tarrytown, N.Y.

[21] Appl. No.: 678,165

[22] Filed: Jul. 11, 1996

[51] Int. Cl.[6] ..... C10L 1/18; C10L 1/22

[52] U.S. Cl. ..... 44/423; 44/426; 44/333

[58] Field of Search ..... 44/423, 426, 333

[56] References Cited

U.S. PATENT DOCUMENTS

| | | | |
|---|---|---|---|
| 1,940,445 | 12/1933 | Calcott et al. | 44/423 |
| 2,305,676 | 12/1942 | Chenleck | 44/72 |
| 2,333,294 | 11/1943 | Chenleck | 44/72 |
| 3,322,520 | 5/1967 | Brimer et al. | 44/74 |
| 3,556,748 | 1/1971 | Stedman | 44/72 |
| 3,759,926 | 9/1973 | Chalmer et al. | 252/386 |
| 4,398,505 | 8/1983 | Cahill | 123/1 A |
| 4,648,885 | 3/1987 | Reid | 44/57 |
| 4,670,131 | 6/1987 | Ferrell | 208/48 |
| 4,824,601 | 4/1989 | Franklin . | |
| 5,136,103 | 8/1992 | Fried | 568/402 |
| 5,169,401 | 12/1992 | Lester et al. | 606/79 |
| 5,169,410 | 12/1992 | Wright | 44/415 |
| 5,254,760 | 10/1993 | Winter et al. | 585/5 |
| 5,322,960 | 6/1994 | Sakamoto et al. | 560/205 |
| 5,412,047 | 5/1995 | Georges et al. | 526/204 |
| 5,460,634 | 10/1995 | Fava et al. | 44/423 |
| 5,495,045 | 2/1996 | Fried | 562/538 |
| 5,496,875 | 3/1996 | Barzatta et al. | 524/99 |
| 5,509,944 | 4/1996 | Venkatadri et al. | 44/430 |

FOREIGN PATENT DOCUMENTS

| | | |
|---|---|---|
| 1316342 | 4/1971 | United Kingdom . |
| 1316342 | 5/1973 | United Kingdom . |

OTHER PUBLICATIONS

S. A. Maslov, et al., Russian Chemical Reviews 56 (8), 715–725(1987).

S. P. Nethsinghe & G. Scott, Rubber Chem Tech. vol. 57 (5), 918 (1984).

*Primary Examiner*—Alan Diamond
*Assistant Examiner*—Cephia D. Toomer
*Attorney, Agent, or Firm*—Luther A. R. Hall

[57] ABSTRACT

The use of nitroxide compounds alone or in combination with aromatic amines, such as substituted phenylenediamines, or phenolic antioxidants provides an effective way to prevent oxidative degradation and gum formation in gasolines, especially unstable coker and pyrolysis gasolines.

41 Claims, No Drawings

STABILIZERS FOR THE PREVENTION OF GUM FORMATION IN GASOLINE

The instant invention pertains to the use of nitroxides either alone or with synergistic coadditives as stabilizers for preventing the formation of gum deposits in gasoline.

BACKGROUND OF THE INVENTION

Gasoline, used extensively as a fuel for internal combustion engines, is a mixture of different hydrocarbons. Gasoline is prepared by a number of different processes. The actual composition of a gasoline is determined in part by the production methods used to formulate it and can also vary with the desired end-use to be made for the fuel. Among production methods are: fractional distillation of crude oil to prepare straight-run gasoline; cracking of high molecular weight hydrocarbons either thermally to prepare coker gasoline or catalytically in a FCC (fluidized catalytic cracker); coupling of low molecular weight propyl and butyl fractions to form dimate gasoline; reforming can catalytically produce high octane gasoline from lower octane feed stocks; and as a by-product of lower olefin (ethylene, propylene, etc.) production to form pyrolysis gasoline or "pygas".

Quite independent of the method used to produce the gasoline, stability, especially by oxidative degradation, is a serious problem. Gasoline, as well as other hydrocarbon fuels, are known to form sticky deposits or gums both upon storage and under actual use conditions. These gummy residues can cause severe problems: for example, such deposits can cause valves to stick and such precipitates may cause filters to clog. These problems can adversely effect both the handling and combustion performance of the fuel. Among the different types of gasolines, pygas and cracked gasoline (both coker and FCC) are the most prone to oxidation and deposit formation.

Work in the area of gasoline stabilization has been performed over many years. One common class of stabilizer for this purpose is the phenylenediamines (PDA) used alone or in admixture with other materials. U.S. Pat. Nos. 3,322,520 and 3,556,748 teach that the phenylenediamine is usually N,N'-disubstituted with the substituents being either aliphatic or aromatic. U.S. Pat. No. 5,509,944 teaches that mixtures of PDA, hindered phenols and dimethyl surfoxide (DMSO) perform better than PDA alone. Phenylenediamines do not function well as stabilizers when the gasoline has a high acid number (>0.1 mg KOH/g gasoline). U.S. Pat. No. 5,169,410 teaches that the use of a strongly basic organic amine can, by preferentially reacting with acid moieties, increase the stabilization efficacy of the phenylenediamine.

U.S. Pat. Nos. 2,305,676 and 2,333,294 demonstrate that the use of N-substituted p-aminophenol derivatives and certain polyamines are effective in stabilizing a variety of gasolines. U.S. Pat. No. 4,648,885 discloses that a mixture of polyamines and N,N-diethylhydroxylamine is an effective stabilizer for distillate fuel oils.

However, despite these efforts to prevent oxidation of gasoline and the gummy deposits causing fouling during use of gasoline, there remains a need to stabilize gasoline more effectively. This need is greatest in the area of the less stable pyrolysis and coker gasolines due to their high level of unsaturation and in gasolines having a high level of acid impurities.

Nitroxides have been known and used for a variety of applications for many years. They have been used as polymerization inhibitors for several vinyl monomers. U.S. Pat. No. 5,254,760 teaches the use of a stable aliphatic nitroxyl compound in conjunction with an aromatic nitro compound to inhibit the polymerization of styrene and other vinyl aromatic compounds. U.S. Pat. No. 5,322,960 discloses mixtures of nitroxide, phenol and phenothiazines as an acrylate polymerization inhibitor. The use of nitroxides in stabilizing butadiene and other low molecular weight olefins during purification is recorded in U.S. Pat. No. 4,670,131. Under specific conditions as taught in U.S. Pat. No. 5,412,047, stable nitroxide radicals can act to control the molecular weight polydispersity and produce "living" polymers. Stable nitroxides have also been used as oxidation catalysts as seen in U.S. Pat. Nos. 5,495,045 and 5,136,103. U.S. Pat. No. 5,496,875 teaches the use of nitroxides as light and thermal stabilizers for polymers.

None of the prior an teaches the use of nitroxides as stabilizers for gasoline. Since nitroxides are non-basic (or neutral), they do not react with any acidic components in the gasoline as described in U.S. Pat. No. 5,169,401. Thus, the nitroxides do not require the use of an amine coadditive as do the phenylenediamines.

OBJECTS OF THE INVENTION

The object of this invention is to provide a method by which gasoline, particularly gasoline produced by cracking or as a by-product of olefin synthesis (pygas), can be stabilized against oxidative degradation and deposit formation.

DETAILED DISCLOSURE

The present invention pertains to the use of nitroxides as an additive for gasoline mixtures that will inhibit its oxidation and prevent the formation of gums or other deposits when gasoline is processed and stored. The gasoline mixture may contain, but is not limited to, one or more of the previously discussed straight-run, coker, FCC, dimate, reformed or pyrolysis gasolines. In particular, the very unstable pyrolysis and coker gasolines are effectively stabilized by the use of the nitroxide stabilizers.

The instant process for the prevention of oxidative degradation and gum or deposit formation comprises adding to gasoline subject to oxidative or thermal induced degradation an effective stabilizing amount of a nitroxide compound.

The effective stabilizing amount of the nitroxide compound is from 0.05 to 10,000 ppm, preferably from 0.1 to 100 ppm, most preferably 0.5 to 25 ppm.

Another embodiment of the instant invention pertains to a process where the effective stabilizer system comprises a synergistic mixture of a nitroxide compound and an aromatic amine, particularly a substituted phenylenediamine, or a phenolic antioxidant or mixture of aromatic amine and phenolic antioxidant.

When such a mixture of nitroxide compound and aromatic amine, particularly a substituted phenylenediamine, or phenolic antioxidant is used, the effective stabilizing amount is from 0.05 to 5000 ppm of nitroxide and 0.05 to 5000 ppm of aromatic amine, particularly substituted phenylenediamine, or phenolic antioxidant, preferably from 0.1 to 100 ppm of nitroxide plus 0.1 to 100 ppm of aromatic amine, especially substituted phenylenediamine, or phenolic antioxidant or mixture of aromatic amine and phenolic antioxidant.

It is also possible to combine the functionalities represented by the synergistic mixture described above in the same molecule. Such a molecule would be the compound described by L. P. Nethsinghe and G. Scott, Rubber Chem. Technology, 57(5), 918 (1984) as 1-oxyl-2,2,6,6-tetramethylpiperidin-4-yl 3,5-di-tert-butyl-4-hydroxyhydrocinnamate.

Preferred embodiments of the instant invention comprise a process wherein the synergistic mixture is from 1 to 95% by weight of nitroxide compound and 99 to 5% by weight of an aromatic amine, phenolic antioxidant or mixture thereof where the ratio of amine to phenolic antioxidant is 5:1 to 1:5.

A more preferred embodiment comprises the mixture which is from 5 to 75% by weight of nitroxide compound and 95 to 25% by weight of an aromatic amine, phenolic antioxidant or mixture thereof where the ratio of amine to phenolic antioxidant is 2:1 to 1:2.

A still more preferred embodiment comprises the mixture which is from 10 to 50% by weight of nitroxide compound and 90 to 50% by weight of an aromatic amine, phenolic antioxidant or mixture thereof where the ratio of amine to phenolic antioxidant is 1:1.

A preferred embodiment is the synergistic mixture where the nitroxide is bis(1-oxyl-2,2,6,6-tewamethylpiperidin-4-yl) sebacate, the aromatic amine is N,N'-di(1,4-dimethylpentyl)phenylenediamine, and the phenolic antioxidant is methyl 3,5-di-tert-butyl-4-hydroxyhydrocinnamate.

Still another embodiment of the instant invention pertains to a composition stabilized against oxidative degradation and against the formation of gum or undesirable deposits which comprises (a) gasoline, particularly unstable gasolines such as pyrolysis or coker gasoline, and (b) an effective stabilizing amount of a nitroxide compound.

Still another embodiment is a gasoline composition which is stabilized against oxidative degradation and against the formation of gum or undesirable deposits which contains an effective synergistic mixture of a nitroxide compound and an aromatic amine, particularly a substituted phenylenediamine, or a phenolic antioxidant or mixture of aromatic amine and phenolic antioxidant.

The nitroxide can be of several different classes. Both aromatic and aliphatic (often hindered amine) nitroxides are shown to be effective in the instant process. Especially preferred are the hindered amine nitroxyl radicals in general, i.e. compounds having at least one NO* group, where the * asterisk denotes an unpaired electron, and the nitrogen atom is further flanked by two carbon atoms, to neither of which hydrogen atoms are attached. These flanking carbon atoms may be further connected by various bridging groups to form cyclic structures such as for example six-membered piperidines, piperazines, five membered pyrrolidines and the like, as exemplified by, but not limited to the list below:

di-tert-butyl nitroxyl, 1-oxyl-2,2,6,6-tetramethylpiperidine, 1-oxyl-2,2,6,6-tetramethylpiperidin-4-ol, 1-oxyl-2,2,6,6-tetramethylpiperidin-4-one, 1-oxyl-2,2,6,6-tetramethylpiperidin-4-yl acetate, 1-oxyl-2,2,6,6-tetramethylpiperidin-4-yl 2-ethylhexanoate, 1-oxyl-2,2,6,6-tetramethylpiperidin-4-yl stearate, 1-oxyl-2,2,6,6-tetramethylpiperidin-4-yl benzoate, 1-oxyl-2,2,6,6-tetramethylpiperidin-4-yl 4-tert-butylbenzoate, bis(1-oxyl-2,2,6,6-tetramethylpiperidin-4-yl)succinate, bis(1-oxyl-2,2,6,6-tetramethylpiperidin-4-yl)adipate, bis(1-oxyl-2,2,6,6-tetramethylpiperidin-4-yl)sebacate, bis(1-oxyl-2,2,6,6-tetramethylpiperidin4-yl)n-butylmalonate, bis(1-oxyl-2,2,6,6-tetramethylpiperidin-4-yl)phthalate, bis(1-oxyl-2,2,6,6-tetramethylpiperidin-4-yl) isophthalate, bis(1-oxyl-2,2,6,6-tetramethylpiperidin-4-yl) terephthalate, bis(1-oxyl-2,2,6,6-tetramethylpiperidin-4-yl) hexahydroterephthalate, N,N'-bis(1-oxyl-2,2,6,6-tetramethylpiperidin-4-yl) adipamide, N-(1-oxyl-2,2,6,6-tetramethylpiperidin-4-yl)caprolactam, N-(1-oxyl-2,2,6,6-tetramethylpiperidin-4-yl) dodecylsuccinimide, 2,4,6-tris-(1-oxyl-2,2,6,6-tetramethylpiperidin-4-yl) cyanurate, 2,4,6-tris-[N-butyl-N-(1-oxyl-2,2,6,6-tetramethylpiperidin-4-yl]-s-triazine, 1-oxyl-2,2,6,6-tetramethylpiperidin-4-yl 3,5-di-tert-butyl-4-hydroxyhydrocinnamate, 4,4'-ethylenebis(1-oxyl-2,2,6,6-tetramethylpiperazin-3-one), or N-oxyl-di-(4-tert-octylphenyl)amine.

The aromatic nitroxide derived from bis(4-di-tert-octylphenyl)amine is effective in inhibiting gum formation when used at concentrations as low as 5 ppm. Especially preferred is the hindered amine nitroxide bis(1-oxyl-2,2,6,6-tetramethylpiperidin-4-yl) sebacate, which shows excellent activity at 5 ppm concentration and shows activity even at concentrations of 1 ppm and lower.

Some phenolic antioxidants of interest are listed below:

Alkylated Monophenols 2,6-di-tert-butyl-4-methylphenol, 2,6-tert-butylphenol, 2-tert-butyl-4,6-dimethylphenol, 2,6-di-tert-butyl-4-ethyl-phenol, 2,6-di-tert-butyl-4-n-butylphenol, 2,6-di-tert-butyl-4-i-butylphenol, 2,6-di-cyclopentyl-4-methylphenol, 2-(β-methylcyclohexyl)-4,6-dimethylphenol, 2,6-di-octa-decyl-4-methylphenol, 2,4,6-tri-cyclohexylphenol, 2,6-di-tert-butyl-4-methoxymethylphenol, o-tert-butylphenol.

Alkylidene-Bisphenols 2,2'-methylene-bis-(6-tert-butyl-4-methylphenol), 2,2'-methylene-bis-(6-tert-butyl-4-ethylphenol), 2,2'-methylene-bis-(4-methyl-6-(α-methyl-cyclohexyl)-phenol), 2,2'-methylene-bis-(4-methyl-6-cyclohexylphenol), 2,2'-methylene-bis-(6-nonyl-4-methylphenol), 2,2'-methylene-bis-(4,6-di-tert-butylphenol), 2,2'-ethylidene-bis(4,6-di-tert-butylphenol), 2,2'-ethylidene-bis-(6-tert-butyl-4- or -5-isobutylphenol), 2,2'-methylene-bis-(6-(α-methylbenzyl-4-nonylphenol), 2,2'-methylene-bis-(6-(α,α-di-methylbenzyl)-4-nonylphenol), 4,4'-methylene-bis-(2,6-di-tert-butyl-phenol), 4,4'-methylene-bis-(6-tert-butyl-2-methylphenol), 1,1-bis-(5-tert-butyl-4-hydroxy-2-methyl-phenol)-butane, 2,6-di-(3-tert-butyl-5-methyl-2-hydroxy-benzyl)-4-methylphenol, 1,1,3-tris-(5-tert-butyl-4-hydroxy-2-methylphenyl)-3-n-dodecyl)-mercaptobutane, ethyleneglycol-bis-[3,3-bis-(3'-tert-butyl-4'-hydroxyphenyl)-butyrate], bis-(3-tert-butyl-4-hydroxy-5-methylphenyl)-dicyclopentadiene, bis-[2-(3'-tert-butyl-2'-hydroxy-5'-methyl-benzyl)-6-tert-butyl-4-methyl-phenyl]-terephthalate.

The phenolic antioxidant of particular interest is selected from the group consisting of n-octadecyl 3,5-di-tert-butyl-4-hydroxyhydrocinnamate, neopentanetetrayl tetrakis(3,5-di-tert-butyl-4-hydroxyhydrocinnamate), di-n-octadecyl 3,5-di-tert-butyl-4-hydroxybenzylphosphonate, thiodiethylene bis(3,5-di-tert-butyl-4-hydroxyhydrocinnamate), 1,3,5-trimethyl-2,4,6-tris(3,5-di-tert-butyl-4-hydroxybenzyl) benzene, 3,6-dioxaoctamethylene bis(3-methyl-5-tert-butyl-4-hydroxyhydrocinnamate), 2,6-di-tert-butyl-p-cresol, 2,2'-ethylidene-bis(4,6-di-tert-butylphenol), 1,1,3,-tris(2-methyl-4-hydroxy-5-tert-butylphenyl)butane, 3,5-di-(3,5-di-tert-butyl-4-hydroxybenzyl)mesitol, hexamethylene bis (3,5-di-tert-butyl-4-hydroxyhydrocinnamate), 1-(3,5-di-tert-butyl-4-hydroxyanilino)-3,5-di(octylthio)-s-triazine, N,N'-hexamethylene-bis(3,5-di-tert-butyl-4-hydroxyhydrocinnamamide), ethylene bis[3,3-di(3-tert-butyl-4-hydroxyphenyl)butyrate], octyl 3,5-di-tert-butyl-4-hydroxybenzylmercaptoacetate, bis(3,5-di-tert-butyl-4-hydroxyhydrocinnamoyl)hydrazide, N,N'-bis[2-(3,5-di-tert-butyl-4-hydroxyhydrocinnamoyloxy)ethyl]-oxamide, 2,6-di-tert-butylphenol, octyl 3,5-di-tert-butyl-4-hydroxyhydrocinnamate and methyl 3,5-di-tert-butyl-4-hydroxyhydrocinnamate.

A most preferred phenolic antioxidant is neopentanetetrayl tetrakis(3,5-di-tert-butyl-4-hydroxyhydrocinnamate), n-octadecyl 3,5-di-tert-butyl-4-hydroxyhydrocinnamate, 1,3,5-trimethyl-2,4,6-tris(3,5-di-tert-butyl-4-hydroxybenzyl)benzene, 2,6-di-tert-butyl-p-cresol, 2,2'-ethylidene-bis(4,6-di-tert-butylphenol) or 3,6-dioxaoctamethylene bis(3-methyl-5-tert-butyl-4-hydroxyhydrocinnamate); and most especially methyl 3,5-di-tert-butyl-4-hydroxyhydrocinnamate, octyl 3,5-di-tert-butyl-4-hydroxyhydrocinnamate or 2,6-di-tert-butylphenol.

Some examples of substituted phenylenediamines which are useful in this invention are listed below:

N,N'-di-isopropyl-p-phenylenediamine,

N,N'-di-sec.-butyl-p-phenylenediamine,

N,N'-di-sec.-butyl-o-phenylenediamine,

N,N'-bis(1,4-dimethylpentyl)-p-phenylenediamine,

N,N'-bis(1-ethyl-3-methyl-pentyl)-p-phenylenediamine,

N,N'-bis(1-methylheptyl)-p-phenylenediamine,

N,N'-dicyclohexyl-p-phenylenediamine,

N,N'-diphenyl-p-phenylenediamine,

N,N'-di-(2-naphthyl)-p-phenylenediamine,

N-isopropyl-N'-phenyl-p-phenylenediamine,

N-sec.-butyl-N'-phenyl-o-phenylenediamine,

N-(1,3-dimethylbutyl)-N'-phenyl-p-phenylenediamine,

N-(1-methylheptyl)-N'-phenyl-p-pbenylenediamine,

N-cyclohexyl-N'-phenyl-p-phenylenediamine,

N,N'-dimethyl-N,N'-di-sec-butyl-p-phenylenediamine;

most especially N,N'-di(1,4-dimethylpentyl) phenylenediamine.

Some examples of other aromatic amines which are useful in this invention are listed below:

diphenylamine, N-allyldiphenylamine, 4-isopropoxydiphenylamine, N-phenyl-1-naphthylamine, N-phenyl-2-naphthylamine, octylated diphenylamine, e.g. p,p'-di-tert-octyldiphenylamine, di-(4-methoxy-phenyl)amine, tert-octylated N-phenyl-1-naphthylamine, mixture of mono- and dialkylated tert-butyl-/tert-octyldiphenylamines.

The preferred aromatic mines of interest are:

N-phenyl-1-naphthylamine, N-phenyl-2-naphthylamine, octylated diphenylamine, especially p,p'-di-tert-octyldiphenylamine.

The following examples are meant for illustrative purposes only and are not to be construed to limit the scope of the instant invention in any manner whatsoever.

Several standard accelerated test methods are known for the evaluation of the stability of fuels in general, and gasoline in particular. Two common ASTM methods for gasoline are (1) D 525 Test Method for Oxidation Stability of Gasoline (Induction Period Method); and (2) D 873 Standard Test Method for Oxidation Stability of Aviation Fuels (Potential Residue Method). Schrepfer and Startsky reported in Gasoline Stability Testing and Inhibitor Application, Nation Fuels and Lubricants Meeting, (1981), that the latter method was much better in predicting the long term deposit formation in both stable and unstable gasolines. This method is used in order to evaluate the instant nitroxide stabilizers.

EXAMPLE 1

The sample of gasoline used in the examples is collected from an olefin production unit (pygas). It is a 1:1 blend of inhibitor-free $C_5$ and $C_{9+}$ streams. The samples are collected in oxygen-free containers cooled in an ice bath and stored in a refrigerator under nitrogen.

In accordance with ASTM D 873-88, a 100 mL sample of pyrolysis gasoline in a bomb is heated in a boiling water bath under oxygen for four hours. The stabilized gasoline samples are prepared by adding 2 mL of a toluene solution of the stabilizer to 98 mL of pyrolysis gasoline producing a total volume of 100 mL. After heating, the aged gasoline is removed from the bomb and the total gum produced is determined.

Table 1 below contains the results obtained when the known gasoline stabilizer N,N'-di(1,4-dimethylpentyl) phenylenediamine, either alone or with a hindered phenolic costabilizer is tested. These formulations are evaluated in order to act as benchmarks for comparing the effectiveness of the nitroxide stabilizer systems.

TABLE 1

Effect of Substituted Phenylenediamine Stabilizer Systems on Pygas Gum Formation in ASTM D 873 Potential Gum Test

| Concentration of Components*(ppm) | | | Soluble Gum |
|---|---|---|---|
| A | B | C | mg/100 mL |
| — | — | — | 569 |
| — | — | — | 618 |
| — | — | — | 583 |
| 12.5 | 12.5 | — | 2.2 |
| 5 | — | — | 400 |
| 5 | — | — | 398 |
| 10 | — | — | 19 |
| 10 | — | — | 21 |
| — | — | 5 | 480 |
| — | — | 10 | 219 |
| 25 | — | 25 | 1.1 |

*A is N,N'-di(1,4-dimethylpentyl)phenylenediamine.
B is octyl 3,5-di-tert-butyl-4-hydroxyhydrocinnamate.
C is methyl 3,5-di-tert-butyl-4-hydroxyhydrocinnamate.

The combination of a substituted phenylenediamine (A) plus an phenolic antioxidant (B) each at a concentration of 12.5 ppm gives 2.2 mg/100 mL gum formation while compound (A) in combination with phenolic antioxidant (C) each at a concentration of 25 ppm reduces gum formation to a desirable low level (1.1 mg/100 mL).

Table 2 below demonstrates the effectiveness of aliphatic and aromatic nitroxide stabilizers when used alone. Even at a concentration of 1 ppm, an aliphatic nitroxide has approximately the equivalent performance of the substituted phenylenediamine stabilizer at 10 ppm. The table also shows that the aromatic nitroxides are also very effective in inhibiting gum formation in gasoline.

TABLE 2

Effect of Nitroxide Stabilizer Systems on Pygas Gum Formation in ASTM D 873 Potential Gum Test

| Concentration of Components*(ppm) | | | Soluble Gum |
|---|---|---|---|
| D | E | G | mg/100 mL |
| 1 | — | — | 30 |
| 2.5 | — | — | 6.0 |
| 4 | — | — | 3.8 |
| 5 | — | — | 2.9 |
| 10 | — | — | 2.0 |
| 10 | — | — | 2.3 |
| 10 | — | — | 2.1 |
| 20 | — | — | 1.8 |
| 50 | — | — | 1.4 |
| — | 5 | — | 10 |
| — | 10 | — | 4.5 (av) |
| — | — | 10 | 2.1 |

*D is bis(1-oxyl-2,2,6,6-tetramethylpiperidin-4-yl) sebacate.
E is N-oxyl-(4-tert-octylphenyl)amine.
G is 1-oxyl-2,2,6,6-tetramethylpiperidin-4-ol.

The hindered amine nitroxides D and G are more effective than the aromatic amine nitroxide E in preventing gum formation. Nitroxides D and G at 10 ppm concentration are roughly 10 times more effective than phenylenediamine A at 10 ppm in preventing gum formation.

Although the nitroxides demonstate superior stabilization performance over the current state of the art, this performance can be further improved by using synergistic mixtures of such nitroxides with various costabilizers as can be seen in Table 3.

TABLE 3

Effect of Nitroxide Stabilizer Systems on Pygas Gum Formation in ASTM D 873 Potential Gum Test

| Concentration of Components* (ppm) | | | | | | Soluble Gum |
|---|---|---|---|---|---|---|
| A | C | D | E | F | G | mg/mL |
| 10 | — | — | — | — | — | 20 (average) |
| — | — | 10 | — | — | — | 2.1 (average) |
| 9.5 | — | 0.5 | — | — | — | 2.5 |
| 9 | — | 1 | — | — | — | 2.1 |
| 8 | — | 2.5 | — | — | — | 2.0 |
| 6 | — | 4 | — | — | — | 1.7 |
| 5 | — | 5 | — | — | — | 1.2 |
| 10 | — | 10 | — | — | — | 0.6 |
| 12 | — | 8 | — | — | — | 0.6 |
| 5 | — | — | 5 | — | — | 2.0 |
| 5 | — | — | — | — | 5 | 0.9 |
| — | 9.5 | 0.5 | — | — | — | 4.2 |
| — | 9 | 1 | — | — | | 1.2 |
| — | 7.5 | 2.5 | — | — | | 0.9 |
| — | 6 | 4 | — | — | | 0.7 |
| — | 5 | 5 | — | — | | 1.6 |
| — | 5 | — | 5 | — | — | 2.7 |
| | 5 | — | — | — | 5 | 0.8 |
| — | — | 5 | — | 5 | — | 2.5 |
| — | — | 10 | — | 10 | — | 1.3 |
| — | — | — | 2.5 | 7.5 | — | 22 |
| — | — | — | 5 | 5 | — | 7.4 |
| — | — | — | 7.5 | 2.5 | — | 6.8 |
| — | — | — | 10 | 10 | — | 3.2 |
| — | — | — | — | 5 | — | 507 |
| — | — | — | — | 10 | — | 448 |
| 3.3 | 3.3 | 3.3 | — | — | — | 1.6 |

*A is N,N'-di(1,4-methylpentyl)phenylenediamine.
C is methyl 3,5-di-tert-butyl-4-hydroxyhydrocinnamate.
D is bis(1-oxyl-2,2,6,6-tetramethylpiperidin-4-yl) sebacate.
E is N-oxyl-di(4-tert-octylphenyl)amine.
F is di(4-tert-octylphenyl)amine.
G is 1-oxyl-2,2,6,6-tetramethylpiperidin-4-ol.

From Table 3 it is clear that the combination of a hindered amine nitroxide D or G with the substituted phenylenediamine A or phenolic antioxidant C gives synergistic stabilization. Even mixtures of nitroxide D or E with diarylamine F, which is itself almost inactive alone, gives effective stabilization.

What is claimed is:

1. A process for the prevention of oxidative degradation and gum or deposit formation in gasoline which comprises adding to gasoline subject to oxidative or thermal induced degradation an effective stabilizing amount of stabilizer system which is a nitroxide compound with the proviso that the nitroxide compound is not di-tert-butyl nitroxyl, 1-oxyl-2,2,6,6-tetramethylpiperidine or a diaryl nitroxide.

2. A process according to claim 1 wherein the effective stabilizing amount of the nitroxide compound is from 0.05 to 10,000 ppm.

3. A process according to claim 2 wherein the effective stabilizing amount of nitroxide compound is from 0.1 to 100 ppm.

4. A process according to claim 3 wherein the effective amount of nitroxide compound is from 0.5 to 25 ppm.

5. A process according to claim 1 wherein the stabilizer system comprises an effective stabilizing amount of a synergistic mixture of the nitroxide compound and an aromatic amine or a phenolic antioxidant or mixture of aromatic amine and phenolic antioxidant.

6. A process according to claim 1 wherein the nitroxide is a hindered amine nitroxide.

7. A process according to claim 1 wherein the nitroxide is 1-oxyl-2,2,6,6-tetramethylpiperidin-4-ol, 1-oxyl-2,2,6,6-tetramethylpiperidin4-one, 1-oxyl-2,2,6,6-tetramethylpiperidin4-yl acetate, 1-oxyl-2,2,6,6-tetramethylpiperidin-4-yl 2-ethylhexanoate, 1-oxyl-2,2,6,6-tetramethylpiperidin-4-yl stearate, 1-oxyl-2,2,6,6-tetramethylpiperidin-4-yl benzoate, 1-oxyl-2,2,6,6-tetramethylpiperidin-4-yl 4-tert-butylbenzoate, bis(1-oxyl-2,2,6,6-tetramethylpiperidin-4-yl)succinate, bis(1-oxyl-2,2,6,6-tetramethylpiperidin-4-yl)adipate, bis(1-oxyl-2,2,6,6-tetramethylpiperidin-4-yl)sebacate, bis(1-oxyl-2,2,6,6-tetramethylpiperidin-4-yl)n-butylmalonate, bis(1-oxyl-2,2,6,6-tetramethylpiperidin-4-yl)phthalate, bis(1-oxyl-2,2,6,6-tetramethylpiperidin-4-yl) isophthalate, bis(1-oxyl-2,2,6,6-tetramethylpiperidin-4-yl) terephthalate, bis(1-oxyl-2,2,6,6-tetramethylpiperidin-4-yl) hexahydroterephthalate, N,N'-bis(1-oxyl-2,2,6,6-tetramethylpiperidin-4-yl) adipamide, N-(1-oxyl-2,2,6,6-tetramethylpiperidin-4-yl)caprolactam, N-(1-oxyl-2,2,6,6-tetramethylpiperidin-4-yl) dodecylsuccinimide, 2,4,6-tris-(1-oxyl-2,2,6,6-tetramethylpiperidin-4-yl) cyanurate, 2,4,6-tris-[N-butyl-N-(1-oxyl-2,2,6,6-tetramethylpiperidin-4-yl]-s-triazine, 1-oxyl-2,2,6,6-tetramethylpiperidin-4-yl 3,5-di-tert-butyl-4-hydroxyhydrocinnamate, or 4,4'-ethylenebis(1-oxyl-2,2,6,6-tetramethylpiperazin-3-one).

8. A process according to claim 7 wherein the nitroxide is bis(1-oxyl-2,2,6,6-tetramethylpiperidin-4-yl)sebacate.

9. A process according to claim 8 wherein the nitroxide is 1-oxyl-2,2,6,6-tetramethylpiperidin-4-ol.

10. A process according to claim 5 wherein the aromatic amine is a substituted phenylenediamine.

11. A process according to claim 5 wherein the effective stabilizing synergistic mixture comprises 0.05 to 5000 ppm of nitroxide compound and 0.05 to 5000 ppm of an aromatic amine, phenolic antioxidant or mixture of aromatic amine and phenolic antioxidant.

12. A process according to claim 11 wherein the amount of nitroxide compound is 0.1 to 100 ppm and the amount of the aromatic amine, phenolic antioxidant or mixture of aromatic amine and phenolic antioxidant is 0.1 to 100 ppm.

13. A process according to claim 5 wherein the aromatic amine is

N,N'-di-isopropyl-p-phenylenediamine,

N,N'-di-sec.-butyl-p-phenylenediamine,

N,N'-di-sec.-butyl-o-phenylenediamine,

N,N'-bis(1,4-dimethylpentyl)-p-phenylenediamine,

N,N'-bis(1-ethyl-3-methylpentyl)-p-phenylenediamine,

N,N'-bis(1-methylheptyl)-p-phenylenediamine,

N,N'-dicyclohexyl-p-phenylenediamine,

N,N'-diphenyl-p-phenylenediamine,

N,N'-di-(2-naphthyl)-p-phenylenediamine,

N-isopropyl-N'-phenyl-p-phenylenediamine,

N-sec.-butyl-N'-phenyl-o-phenylenediamine,

N-(1,3-dimethylbutyl)-N'-phenyl-p-phenylenediamine,

N-(1-methylheptyl)-N'-phenyl-p-phenylenediamine,

N-cyclohexyl-N'-phenyl-p-phenylenediamine,

N,N'-dimethyl-N,N'-di-sec-butyl-p-phenylenediamine,

N,N'-di(1,4-dimethylpentyl)-o-phenylenediamine, diphenylamine,

N-allyldiphenylamine, di-(4-isopropoxyphenyl)amine,

N-phenyl-1-naphthylamine,

N-phenyl-2-naphthylamine, octylated diphenylamine, di-(4-methoxy-phenyl)amine, tert-octylated N-phenyl-1-naphthylamine, or a mixture of mono- and dialkylated tert-butyl-/tert-octyldiphenylamines.

14. A process according to claim 13 wherein the aromatic amine is N-phenyl-1-naphthylamine, N-phenyl-2-naphthylamine, octylated diphenylamine, a mixture of mono- and dialkylated tert-butyl-/tert-octyldiphenylamines, or N,N'-di(1,4-dimethylpentyl)-p-phenylenediamine.

15. A process according to claim 5 wherein the phenolic antioxidant is neopentanetetrayl (3,5-di-tert-butyl-4-hydroxyhydrocinnamate), n-octadecyl 3,5-di-tert-butyl-4-hydroxyhydrocinnamate, 1,3,5-trimethyl-2,4,6-tris(3,5-di-tert-butyl-4-hydroxybenzyl)benzene, 2,6-di-tert-butyl-p-cresol, 2,2'-ethylidene-bis(4,6-di-tert-butylphenol), methyl 3,5-di-tert-butyl-4-hydroxyhydrocinnamate, octyl 3,5-di-tert-butyl-4-hydroxyhydrocinnamate, 2,6-di-tert-butylphenol or 3,6-dioxaoctamethylene bis(3-methyl-5-tert-butyl-4-hydroxyhydrocinnamate).

16. A process according to claim 15 wherein the phenolic antioxidant is methyl 3,5-di-tert-butyl-4-hydroxyhydrocinnamate, octyl 3,5-di-tert-butyl-4-hydroxyhydrocinnamate or 2,6-di-tert-butylphenol.

17. A process according to claim 5 wherein the synergistic mixture is from 1 to 95% by weight of nitroxide compound and 99 to 5% by weight of an aromatic amine, phenolic antioxidant or mixture thereof where the ratio of amine to phenolic antioxidant is 5:1 to 1:5.

18. A process according to claim 17 wherein the mixture is from 5 to 75% by weight of nitroxide compound and 95 to 25% by weight of an aromatic amine, phenolic antioxidant or mixture thereof where the ratio of amine to phenolic antioxidant is 2:1 to 1:2.

19. A process according to claim 18 wherein the mixture is from 10 to 50% by weight of nitroxide compound and 90 to 50% by weight of an aromatic amine, phenolic antioxidant or mixture thereof where the ratio of amine to phenolic antioxidant is 1:1.

20. A process according to claim 17 wherein the nitroxide is bis(1-oxyl-2,2,6,6-tetramethylpiperidin-4-yl)sebacate, the aromatic amine is N,N'-di(1,4-dimethylpentyl) phenylenediamine, and the phenolic antioxidant is methyl 3,5-di-tert-butyl-4-hydroxyhydrocinnamate.

21. A composition stabilized against oxidative degradation and against the formation of gum or undesirable deposits which comprises (a) gasoline subject to oxidative degradation, and (b) an effective stabilizing amount of a stabilizer system which is a nitroxide compound, and with the proviso that the nitroxide is not di-tert-butyl nitroxyl, 1-oxyl-2,2,6,6-tetramethylpiperidine or a diaryl nitroxide.

22. A composition according to claim 20 wherein the gasoline is pyrolysis or coker gasoline.

23. A composition according to claim 21 wherein the effective stabilizing amount of the nitroxide compound is from 0.05 to 10,000 ppm.

24. A composition according to claim 23 wherein the effective stabilizing amount of nitroxide compound is from 0.1 to 100 ppm.

25. A composition according to claim 24 wherein the effective amount of nitroxide compound is from 0.5 to 25 ppm.

26. A composition according to claim 21 wherein the stabilizer system comprises an effective stabilizing amount of a synergistic mixture the nitroxide compound and an aromatic amine or a phenolic antioxidant or mixture of aromatic amine and phenolic antioxidant.

27. A composition according to claim 21 wherein the nitroxide is a hindered amine nitroxide.

28. A composition according to claim 21 wherein the nitroxide is 1-oxyl-2,2,6,6-tetramethylpiperidin-4-ol, 1-oxyl-2,2,6,6-tetramethylpiperidin-4-one, 1-oxyl-2,2,6,6-tetramethylpiperidin-4-yl acetate, 1-oxyl-2,2,6,6-tetramethylpiperidin-4-yl 2-ethylhexanoate, 1-oxyl-2,2,6,6-tetramethylpiperidin4-yl stearate, 1-oxyl-2,2,6,6-tetramethylpiperidin-4-yl benzoate, 1-oxyl-2,2,6,6-tetramethylpiperidin-4-yl 4-tert-butylbenzoate, bis(1-oxyl-2,2,6,6-tetramethylpiperidin-4-yl)succinate, bis(1-oxyl-2,2,6,6-tetramethylpiperidin-4-yl)adipate, bis(1-oxyl-2,2,6,6-tetramethylpiperidin-4-yl)sebacate, bis(1-oxyl-2,2,6,6-tetramethylpiperidin-4-yl)n-butylmalonate, bis(1-oxyl-2,2,6,6-tetramethylpiperidin-4-yl)phthalate, bis(1-oxyl-2,2,6,6-tetramethylpiperidin-4-yl) isophthalate, bis(1-oxyl-2,2,6,6-tetramethylpiperidin-4-yl) terephthalate, bis(1-oxyl-2,2,6,6-tetramethylpiperidin-4-yl) hexahydroterephthalate, N,N'-bis(1-oxyl-2,2,6,6-tetramethylpiperidin-4-yl) adipamide, N-(1-oxyl-2,2,6,6-tetramethylpiperidin-4-yl)caprolactam, N-(1-oxyl-2,2,6,6-tetramethylpiperidin-4-yl) dodecylsuccinimide, 2,4,6-tris-(1-oxyl-2,2,6,6-tetramethylpiperidin-4-yl) cyanurate, 2,4,6-tris-[N-butyl-N-(1-oxyl-2,2,6,6-tetramethylpiperidin-4-yl]-s-triazine, 1-oxyl-2,2,6,6-tetramethylpiperidin-4-yl 3,5-di-tert-butyl-4-hydroxyhydrocinnamate, or 4,4'-ethylenebis(1-oxyl-2,2,6,6-tetramethylpiperazin-3-one).

29. A composition according to claim 28 wherein the nitroxide is bis(1-oxyl-2,2,6,6-tetramethylpiperidin4-yl) sebacate.

30. A composition according to claim 28 wherein the nitroxide is 1-oxyl-2,2,6,6-tetramethylpiperidin-4-ol.

31. A composition according to claim 26 wherein the aromatic amine is a substituted phenylenediamine.

32. A composition according to claim 26 wherein the effective stabilizing synergistic mixture comprises 0.05 to 5000 ppm of nitroxide compound and 0.05 to 5000 ppm of an aromatic amine, phenolic antioxidant or mixture of aromatic amine and phenolic antioxidant.

33. A composition according to claim 32 wherein the amount of nitroxide compound is 0.1 to 100 ppm and the amount of the aromatic amine, phenolic antioxidant or mixture of aromatic amine and phenolic antioxidant is 0.1 to 100 ppm.

34. A composition according to claim 26 wherein the aromatic amine is

N,N'-di-isopropyl-p-phenylenediamine,

N,N'-di-sec.-butyl-p-phenylenediamine,

N,N'-di-sec.-butyl-o-phenylenediamine,

N,N'-bis(1,4-dimethylpentyl)-p-phenylenediamine,

N,N'-bis(1-ethyl-3-methylpentyl)-p-phenylenediamine,

N,N'-bis(1-methylheptyl)-p-phenylenediamine,

N,N'-dicyclohexyl-p-phenylenediamine,

N,N'-diphenyl-p-phenylenediamine,

N,N'-di-(2-naphthyl)-p-phenylenediamine,

N-sec.-butyl-N'-phenyl-o-phenylenediamine,

N-isopropyl-N'-phenyl-p-phenylenediamine,

N-(1,3-dimethylbutyl)-N'-phenyl-p-phenylenediamine,

N-(1-methylheptyl)-N'-phenyl-p-phenylenediamine,

N-cyclohexyl-N'-phenyl-p-phenylenediamine,

N,N'-dimethyl-N,N'-di-sec-butyl-p-phenylenediamine,

N,N'-di(1,4-dimethylpentyl)-o-phenylenediamine, diphenylamine,

N-allyldiphenylamine, di-(4-isopropoxyphenyl)amine,

N-phenyl-1-naphthylamine,

N-phenyl-2-naphthylamine, octylated diphenylamine, di-(4-methoxy-phenyl)amine, tert-octylated N-phenyl-1-naphthylamine, or a mixture of mono- and dialkylated tert-butyl-/tert-octyldiphenylamines.

35. A composition according to claim 34 wherein the aromatic amine is N-phenyl-1-naphthylamine, N-phenyl-2-naphthylamine, octylated diphenylamine, a mixture of mono- and dialkylated tert-butyl-/tert-octyldiphenylamines, or N,N'-di(1,4-dimethylpentyl)-p-phenylenediamine.

36. A composition according to claim 26 wherein the phenolic antioxidant is neopentanetetrayl (3,5-di-tert-butyl-4-hydroxyhydrocinnamate), n-octadecyl 3,5-di-tert-butyl-4-hydroxyhydrocinnamate, 1,3,5-trimethyl-2,4,6-tris(3,5-di-tert-butyl-4-hydroxybenzyl)benzene, 2,6-di-tert-butyl-p-cresol, 2,2'-ethylidene-bis(4,6-di-tert-butylphenol), methyl 3,5-di-tert-butyl-4-hydroxyhydrocinnamate, octyl 3,5-di-tert-butyl-4-hydroxyhydrocinnamate, 2,6-di-tert-butylphenol or 3,6-dioxaoctamethylene bis(3-methyl-5-tert-butyl-4-hydroxyhydrocinnamate).

37. A composition according to claim 36 wherein the phenolic antioxidant is methyl 3,5-di-tert-butyl-4-hydroxyhydrocinnamate, octyl 3,5-di-tert-butyl-4-hydroxyhydrocinnamate or 2,6-di-tert-butylphenol.

38. A composition according to claim 26 wherein the synergistic mixture is from 1 to 95% by weight of nitroxide compound and 99 to 5% by weight of an aromatic amine, phenolic antioxidant or mixture thereof where the ratio of amine to phenolic antioxidant is 5:1 to 1:5.

39. A composition according to claim 38 wherein the mixture is from 5 to 75% by weight of nitroxide compound and 95 to 25% by weight of an aromatic amine, phenolic antioxidant or mixture thereof where the ratio of amine to phenolic antioxidant is 2:1 to 1:2.

40. A composition according to claim 39 wherein the mixture is from 10 to 50% by weight of nitroxide compound and 90 to 50% by weight of an aromatic amine, phenolic antioxidant or mixture thereof where the ratio of amine to phenolic antioxidant is 1:1.

41. A composition according to claim 38 wherein the nitroxide is bis(1-oxyl-2,2,6,6-tetramethylpiperidin-4-yl) sebacate, the aromatic amine is N,N'-di(1,4-dimethylpentyl) phenylenediamine, and the phenolic antioxidant is methyl 3,5-tert-butyl-4-hydroxyhydrocinnamate.

* * * * *